US007753604B2

(12) United States Patent
Naito

(10) Patent No.: US 7,753,604 B2
(45) Date of Patent: Jul. 13, 2010

(54) INK SHEET CARTRIDGE

(75) Inventor: Takahiro Naito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 1126 days.

(21) Appl. No.: 11/377,215

(22) Filed: Mar. 17, 2006

(65) Prior Publication Data

US 2006/0239743 A1 Oct. 26, 2006

(30) Foreign Application Priority Data

Apr. 25, 2005 (JP) ..... 2005-126120

(51) Int. Cl.
*B41J 35/28* (2006.01)

(52) U.S. Cl. ..... 400/207; 347/214

(58) Field of Classification Search ..... 400/207, 400/208, 208.1, 248; 347/214; 220/617, 220/835; 242/348.4; 396/512, 535; 403/329, 403/372; 312/111, 140; 24/571.1, 584.1, 24/593.1, 593.11, 598.1, 700, 701, 702
See application file for complete search history.

(56) References Cited

U.S. PATENT DOCUMENTS

| | | | | | |
|---|---|---|---|---|---|
| 4,584,897 | A * | 4/1986 | Sharp, Jr. | ..... | 74/483 PB |
| 5,193,759 | A * | 3/1993 | Bigelow et al. | ..... | 242/348.4 |
| 5,244,400 | A * | 9/1993 | Hatagishi | ..... | 439/157 |
| 5,482,223 | A * | 1/1996 | Bresina et al. | ..... | 242/348.4 |
| 5,533,642 | A * | 7/1996 | Lafond et al. | ..... | 220/326 |
| 5,575,399 | A * | 11/1996 | Intini | ..... | 220/835 |
| 5,876,225 | A * | 3/1999 | Katsuma et al. | ..... | 439/157 |
| 5,888,080 | A * | 3/1999 | Maejima | ..... | 439/157 |
| 5,936,654 | A * | 8/1999 | Yokoyama et al. | ..... | 347/217 |
| 6,062,882 | A * | 5/2000 | Hanazaki et al. | ..... | 439/157 |
| 6,343,840 | B1 * | 2/2002 | Chuang | ..... | 297/411.36 |
| 7,410,073 | B2 * | 8/2008 | Yuhara | ..... | 220/212 |
| 7,450,141 | B2 * | 11/2008 | Yamamoto | ..... | 347/214 |
| 2001/0012710 | A1 * | 8/2001 | Kumakura et al. | ..... | 439/157 |
| 2002/0017544 | A1 * | 2/2002 | Lee et al. | ..... | 224/627 |
| 2003/0217761 | A1 * | 11/2003 | Maelstaf | ..... | 132/294 |
| 2004/0031867 | A1 * | 2/2004 | Hiraguchi et al. | ..... | 242/346 |
| 2005/0052523 | A1 | 3/2005 | Kaida et al. | | |
| 2005/0172981 | A1 * | 8/2005 | Byun | ..... | 132/287 |

(Continued)

FOREIGN PATENT DOCUMENTS

GB 1 589 350 A 5/1981

(Continued)

OTHER PUBLICATIONS

European Search Report dated Sep. 26, 2006 (Five (5) pages).

*Primary Examiner*—Judy Nguyen
*Assistant Examiner*—David Banh
(74) *Attorney, Agent, or Firm*—Crowell & Moring LLP

(57) ABSTRACT

An ink sheet cartridge provided with a bobbin case easy to assemble and disassemble, formed with no protrusion on the outer surface thereof and capable of inhibiting the number of components from increase is obtained. This ink sheet cartridge is provided with a pawl and a receiving portion on upper and lower components respectively. The pawl is provided with a projecting engaging portion, and the receiving portion is provided with a groove engaging with the engaging portion. The groove has a guide for guiding the engaging portion and a stop portion fixing the engaging portion.

20 Claims, 13 Drawing Sheets

U.S. PATENT DOCUMENTS

| | | | | |
|---|---|---|---|---|
| 2006/0017217 | A1* | 1/2006 | Maeda | 271/162 |
| 2006/0032860 | A1* | 2/2006 | Hase | 220/831 |
| 2006/0144890 | A1* | 7/2006 | Haramiishi et al. | 227/120 |

FOREIGN PATENT DOCUMENTS

| | | | |
|---|---|---|---|
| JP | 6-246995 | A | 9/1994 |
| JP | 9-136464 | A | 5/1997 |
| JP | 9-323456 | A | 12/1997 |
| JP | 2005-47054 | A | 2/2005 |
| WO | WO 03/080352 | A1 | 10/2003 |

* cited by examiner

INK SHEET CARTRIDGE

BACKGROUND OF THE INVENTION

1. Field of the Invention

The present invention relates to an ink sheet cartridge, and more particularly, it relates to an ink sheet cartridge mounted on a printer.

2. Description of the Background Art

An ink sheet cartridge mounted on a printer is known in general. For example, Japanese Patent Laying-Open Nos. 9-136464 (1997), 6-246995 (1994), 9-323456 (1997) and 2005-47054 disclose such ink sheet cartridges.

The aforementioned Japanese Patent Laying-Open No. 9-136464 discloses an ink ribbon cartridge (ink sheet cartridge) including a shell (bobbin case) having a spool storage portion rotatably storing a ribbon feed spool (feed bobbin) wound with an ink ribbon and a ribbon take-up spool (take-up bobbin) taking up a spent ink ribbon, in which the shell is constituted of a shell body having the spool storage portion and a lid while the lid is openable/closable with a hinge integrally formed on the shell body. In this ink ribbon cartridge, an engaging pawl of an engaging section provided on the lid and an engaging hole provided on the shell body engage with each other, thereby fixing the lid in a closed state. The hinge, integrally formed on the shell body, is provided with a protrusion. In this ink ribbon cartridge according to Japanese Patent Laying-Open No. 9-136464, it is possible to recycle the shell (bobbin case) by opening the lid after using the ink ribbon, exchanging the spool and thereafter closing the lid again.

The aforementioned Japanese Patent Laying-Open No. 6-246995 discloses an ink ribbon cartridge (ink sheet cartridge) including a shell (bobbin case) having a spool storage portion rotatably storing a ribbon feed spool (feed bobbin) wound with an ink ribbon and a ribbon take-up spool (take-up bobbin) taking up a spent ink ribbon, in which the shell is constituted of a shell body having the spool storage portion and a lid separated from the shell body while the lid and the shell body are combined with each other for rendering the lid openable/closable. In this ink ribbon cartridge, an engaging pawl of an engaging section provided on the lid and an engaging hole provided on the shell body engage with each other, thereby fixing the lid in a closed state. The hinge is in a protruding state for fixing the lid in the openable/closable manner. In the ink ribbon cartridge according to Japanese Patent Laying-Open No. 6-246995, it is possible to recycle the shell by opening the lid after using the ink ribbon, exchanging the spool and thereafter closing the lid again, similarly to the aforementioned ink ribbon cartridge according to Japanese Patent Laying-Open No. 9-136464.

The aforementioned Japanese Patent Laying-Open No. 9-323456 discloses a cassette case (bobbin case) formed by an upper cassette (upper component) and a lower cassette (lower component) rotatably storing a feed bobbin delivering a sheet and a take-p bobbin taking up the sheet respectively, in which two slidable fasteners are mounted on a coupling portion of the upper cassette coupling the upper and lower cassettes with each other so that the upper and lower cassettes are fixable. The upper and lower cassettes of this cassette case can be separated from each other by sliding the fasteners. Further, it is possible to recycle the body of this cassette case by exchanging spent feed and take-up bobbins and thereafter fixing the upper and lower cassettes to each other again.

The aforementioned Japanese Patent Laying-Open No. 2005-47054 discloses a thermal transfer sheet cassette (ink sheet cartridge) storing a sheet body formed by a take-up core (take-up bobbin), a feed core (fed bobbin) and a thermal transfer sheet (ink sheet), on which lid bodies and a core holder can be easily mounted by engaging concave rails provided in the core holder and protrusions provided on the lid bodies with each other thereby guiding the protrusions provided on the lid bodies along the concave rails. This thermal transfer sheet cassette has the core holder rotatably storing the take-up core and the feed core and the two lid bodies covering the core holder.

An ink sheet cartridge applied to a thermal transfer printer is also known in general. The structure of a conventional ink sheet cartridge 100 is described with reference to FIGS. 16 to 23.

As shown in FIG. 16, the conventional ink sheet cartridge 100 comprises a resin upper component 102 and a resin lower component 103 constituting a bobbin case 101, a fed bobbin 104 feeding an ink sheet 106, a take-up bobbin 105 taking up the ink sheet 106 and the ink sheet 106.

The upper component 102 constituting the bobbin case 101 includes a feed bobbin storage portion 102*a* storing the feed bobbin 104, a take-up bobbin storage portion 102*b* storing the take-up bobbin 105 and coupling portions 102*c* and 102*d* coupling the feed bobbin storage portion 102*a* and the take-up bobbin storage portion 102*b* with each other, as shown in FIG. 16. A reinforcing portion 102*j* for preventing the ink sheet cartridge 100 from twisting resulting from a load applied in printing is provided on the coupling portion 102*d* of the upper component 102, to extend perpendicularly to the surface of the coupling portion 102*d*. Feed bobbin holding portions 102*e* rotatably holding the feed bobbin 104 are provided in the feed bobbin storage portion 102*a*, while take-up bobbin holding portions 102*f* rotatably holding the take-up bobbin 105 are provided in the take-up bobbin storage portion 102*b*. U-shaped engaging portions 102*g* for fixing the lower component 103 are provided on first end surfaces of the feed bobbin storage portion 102*a* and the take-up bobbin storage portion 102*b* of the upper component 102 respectively. Downwardly projecting pawls 102*h* for fixing the lower component 103 are provided on portions close to second ends of the feed bobbin storage portion 102*a* and the take-up bobbin storage portion 102*b* of the upper component 102 respectively. Steps 102*i* for fixing the lower component 103 are provided on the inner surfaces of the pawls 102*h* respectively.

Similarly to the upper component 102, the lower component 103 constituting the bobbin case 101 includes a feed bobbin storage portion 103*a* storing the feed bobbin 104, a take-up bobbin storage portion 103*b* storing the take-up bobbin 105 and coupling portions 103*c* and 103*d* coupling the feed bobbin storage portion 103*a* and the take-up bobbin storage portion 103*b* with each other, as shown in FIG. 16. Feed bobbin support portions 103*e* rotatably supporting the feed bobbin 104 are provided in the feed bobbin storage portion 103*a*, while take-up bobbin support portions 103*f* rotatably supporting the take-up bobbin 105 are provided in the take-up bobbin storage portion 103*b*. Protrusions 103*g* engaging with the U-shaped engaging portions 102*g* of the upper component 102 are provided on first end surfaces of the feed bobbin storage portion 103*a* and the take-up bobbin storage portion 103*b* of the lower component 103 respectively. Concave receiving portions 103*h* receiving the pawls 102*h* of the upper component 102 are provided on portions close to second ends of the feed bobbin storage portion 103*a* and the take-up bobbin storage portion 103*b* of the lower component 103 respectively. The concave receiving portions 103*h* are provided with engaging portions 103*i* engaging with the steps 102*i* of the pawls 102*h* respectively.

The feed bobbin 104 is provided with a sheet feed shaft 104*a* wound with the ink sheet 106, flanges 104*b*, a drive shaft 104*c*, an engaging portion 104*d*, provided on the drive shaft 104*c*, having three recess portions engaging with bobbin drive reels of a printer (not shown) and a follower shaft 104*e*.

The take-up bobbin 105 is provided with a sheet take-up shaft 105*a* taking up the ink sheet 106, flanges 105*b*, a drive shaft 105*c*, an engaging portion 105*d*, provided on the drive shaft 105*c*, having three recess portions engaging with bobbin drive reels of the printer (not shown) and a follower shaft 105*e*.

A method of combining the upper and lower components 102 and 103 of the conventional ink sheet cartridge 100 with each other is now described with reference to FIGS. 18 to 23. First, the engaging portions 102*g* of the upper component 102 are engaged with the protrusions 103*g* of the lower component 103. Thereafter the pawls 102*h* of the upper component 102 are moved along arrow A in FIGS. 18, 19, 21 and 22, to be inserted into the concave receiving portions 103*h* of the lower component 103. Thus, the steps 102*i* of the pawls 102*h* provided on the upper component 102 engage with the engaging portions 103*i* provided on the concave receiving portions 103*h* of the lower component 103 as shown in FIGS. 20 and 23, thereby fixing the upper and lower components 102 and 103 to each other. At this time, the upper component 102 is hard to bend due to the reinforcing portions 102*j* provided on the coupling portions 102*d* of the upper component 102 for preventing the ink sheet cartridge 100 from twisting resulting from a load applied in loading. In order to insert the pawls 102*h* of the upper component 102 into the receiving portions 103*h* of the lower component 103, therefore, the lower component 103 is bent along arrow B (inward) shown in FIGS. 19 and 22, thereby inserting the pawls 102*h* into the receiving portions 103*h*. In order to separate the upper and lower components 102 and 103 from each other, on the other hand, the pawls 102*h* of the upper component 102 are outwardly bent for disengaging the pawls 102*h* from the receiving portions 103*h* of the lower component 103.

In the conventional ink sheet cartridge 100 shown in FIGS. 16 to 23, however, the lower component 103, which must be inwardly bent when combined with the upper component 102 as described above, may disadvantageously be broken. Further, the upper component 102 is hard to bend due to the reinforcing portions 102*j* provided on the coupling portions 102*d* for preventing the ink sheet cartridge 100 from twisting resulting from a load in printing, while the pawls 102*h* are hard to deflect due to the thickness larger than those of the remaining portions. Thus, it is difficult to disengage the pawls 102*h* from the receiving portions 103*h*, and the pawls 102*h* may disadvantageously be broken due to application of an excessive load when the same are forcibly bent outward to be disengaged from the receiving portions 102*h*. Therefore, it is difficult to disassemble the bobbin case 101.

In the ink ribbon cartridge (ink sheet cartridge) disclosed in the aforementioned Japanese Patent Laying-Open No. 9-136464, the lid is rendered openable/closable with the hinge integrally formed on the shell body, to result in the protrusion provided on the hinge. Therefore, the outer size of the ink ribbon cartridge is increased due to the protrusion, and components provided in a printer may disadvantageously come into contact with the protrusion.

Also in the ink ribbon cartridge (ink sheet cartridge) disclosed in the aforementioned Japanese Patent Laying-Open No. 6-246995, the lid is rendered openable/closable with the hinge integrally formed on the shell body to result in the protrusion provided on the hinge, similarly to the ink ribbon cartridge disclosed in Japanese Patent Laying-Open No. 9-136464. Therefore, the outer size of the ink ribbon cartridge is increased due to the protrusion, and components provided in a printer may disadvantageously come into contact with the protrusion. Further, the shell body and the lid separated from the shell body are combined with each other through the hinge, and hence it disadvantageously takes time for assembling the hinge.

The cassette case disclosed in the aforementioned Japanese Patent Laying-Open No. 9-323456 disadvantageously requires the two slidable fasteners for fixing the upper and lower cassettes to each other. Therefore, the number of components is disadvantageously increased.

In the thermal transfer sheet cassette disclosed in the aforementioned Japanese Patent Laying-Open No. 2005-47054 constituted of the core holder and the two lid bodies, the number of components as well as the number of assembling steps are disadvantageously increased as compared with a case of covering the core holder with a single lid body.

SUMMARY OF THE INVENTION

The present invention has been proposed in order to solve the aforementioned problems, and an object of the present invention is to provide an ink sheet cartridge provided with a bobbin case easy to assemble and disassemble, formed with no protrusion on the outer surface thereof and capable of inhibiting the number of components from increase.

An ink sheet cartridge according to a first aspect of the present invention comprises an ink sheet for printing, a feed bobbin wound with the ink sheet, a take-up bobbin for taking up the ink sheet and a bobbin case, constituted of an upper component and a lower component in a vertically dividable manner, rotatably storing the feed bobbin and the take-up bobbin, while a projecting engaging portion is integrally provided on either the upper component or the lower component and a groove having a guide for guiding the projecting engaging portion and a stop portion fixing the projecting engaging portion is provided on either the lower component or the upper component.

In the ink sheet cartridge according to the first aspect of the present invention, as hereinabove described, the projecting engaging portion is provided on either the upper component or the lower component while the groove having the guide for guiding the projecting engaging portion and the stop portion fixing the projecting engaging portion is provided on either the lower component or the upper component so that the projecting engaging portion is guided along the guide of the groove to thereafter engage with the stop portion of the groove when the upper and lower components are combined with each other, whereby the projecting engaging portion can be prevented from application of an excessive load. Further, the engagement between the projecting engaging portion and the stop portion can be canceled by separating the projecting engaging portion from the stop portion, whereby the upper and lower components can be easily separated from each other. Thus, the bobbin case can be easily assembled and disassembled. In addition, the projecting engaging portion is so integrally provided on either the upper component or the lower component that the number of components can be inhibited from increase despite the provision of the projecting engaging portion.

In the aforementioned ink sheet cartridge according to the first aspect, the upper component preferably includes a pawl provided with the projecting engaging portion on the outer side surface thereof, the lower component preferably includes a concave receiving portion receiving the pawl, and the groove is preferably provided on the inner side surface of the concave receiving portion. According to this structure, the projecting engaging portion provided on the pawl received in the concave receiving portion engages with the groove provided on the inner side surface of the concave receiving portion. Thus, the pawl is guided and bent along the guide of the groove and the projecting engaging portion provided on the pawl is guided to restore the bent pawl on an end position of the guide so that the projecting engaging portion provided on the pawl comes into contact with the stop portion of the groove provided on the side surface of the concave receiving portion and is fixed thereto. Further, the projecting engaging portion provided on the pawl and the stop portion of the groove provided on the side surface of the concave receiving portion can be separated from each other for releasing the engaging portion by plunging the pawl. Consequently, the bobbin case can be easily assembled and disassembled.

In this case, the upper component and the lower component are preferably fixed to each other without protruding the outer surface of the pawl beyond the outer surface of the bobbin case while the pawl is inserted into the concave receiving portion and the projecting engaging portion provided on the pawl is fixed by the stop portion. According to this structure, no protrusion is formed on the outer surface of the bobbin case, whereby the outer size of the bobbin case can be prevented from increase while no protrusion comes into contact with components provided in a printer.

In the aforementioned ink sheet cartridge having the upper and lower components fixed to each other without protruding the outer surface of the pawl beyond the outer surface of the bobbin case, the upper component and the lower component are preferably so fixed to each other that the outer surface of the pawl is substantially flush with the outer surface of the lower component while the pawl is inserted into the concave receiving portion and the projecting engaging portion provided on the pawl is fixed by the stop portion. According to this structure, the outer surface of the pawl can be easily inhibited from protruding beyond the outer surface of the lower component so that no step is formed between the outer surfaces of the pawl and the lower component while the upper and lower components are fixed to each other.

In the aforementioned ink sheet cartridge provided with the pawl and the concave receiving portion, the projecting engaging portion is preferably provided on each of both outer side surfaces of the pawl, and the groove is preferably provided on each of both inner side surfaces of the concave receiving portion. According to this structure, the pawl can be more stably guided along the guides of the grooves due to engagement between the pair of projecting engaging portions and the pair of grooves while the projecting engaging portions can be more stably fixed due to contact between the stop portions of the pair of grooves and the pair of projecting engaging portions.

In the aforementioned ink sheet cartridge according to the first aspect, a chamfer is preferably provided around the inlet of the guide of the groove. According to this structure, the portion around the inlet of the guide of the groove is so widened that the projecting engaging portion provided on the pawl can easily engage with the guide of the groove provided on the side surface of the concave receiving portion. Thus, the bobbin case can be more easily assembled.

In the aforementioned ink sheet cartridge provided with the pawl and the concave receiving portion, the projecting engaging portion provided on the pawl preferably engages with the stop portion of the groove provided on the concave receiving portion in a state inwardly movable into the bobbin case. According to this structure, the projecting engaging portion can be easily moved into the bobbin case by externally plunging the pawl provided with the projecting engaging portion into the bobbin case in the state of the engagement between the projecting engaging portion and the stop portion of the groove when separating the upper and lower components from each other.

In this case, the engagement between the engaging portion of the pawl and the stop portion of the groove is preferably canceled by externally plunging the pawl into the bobbin case in the state of the engagement between the engaging portion and the stop portion. According to this structure, the engagement between the engaging portion and the stop portion can be easily canceled by externally plunging the pawl into the bobbin case when separating the upper and lower components from each other since the pawl can be more easily plunged into the bobbin case as compared with a case of pulling out the pawl from the bobbin case.

In this case, further, the upper component and the lower component are preferably separated from each other by moving at least either the upper component or the lower component to separate from either the lower component or the upper component after cancellation of the engagement between the engaging portion and the stop portion. According to this structure, the projecting engaging portion provided on the pawl of the upper component can be moved along the guide of the groove provided on the concave receiving portion of the lower component when the engagement between the engaging portion and the stop portion is canceled, whereby at least either the upper component or the lower component can be easily separated from either the lower component or the upper component. Consequently, the upper and lower components can be easily separated from each other by moving at least either the upper component or the lower component to separate from either the lower component or the upper component.

In the aforementioned ink sheet cartridge according to the first aspect, the guide of the groove and the stop portion of the groove are preferably continuously formed. According to this structure, the guide and the stop portion of the groove are so continuous that the projecting engaging portion can be easily moved from the guide of the groove toward the stop portion of the groove when combining the upper and lower components with each other, while the projecting engaging portion can be easily moved from the stop portion of the groove toward the guide of the groove when separating the upper and lower components from each other.

In the aforementioned ink sheet cartridge including the groove having the continuously formed guide and stop portion, the engaging portion of the pawl is preferably moved from the stop portion of the groove toward the guide of the groove by externally plunging the pawl into the bobbin case in the state where the pawl is inserted into the concave receiving portion for engaging the projecting engaging portion provided on the pawl and the stop portion of the groove with each other. According to this structure, the engaging portion of the pawl can be more easily moved from the stop portion of the groove toward the guide of the groove when separating the upper and lower components, whereby the engaging portion of the pawl can be easily moved along the guide of the groove.

An ink sheet cartridge according to a second aspect of the present invention comprises an ink sheet for printing, a feed bobbin wound with the ink sheet, a take-up bobbin for taking up the ink sheet and a bobbin case, constituted of an upper component and a lower component in a vertically dividable manner, rotatably storing the feed bobbin and the take-up bobbin, while the upper component of the bobbin case includes a pawl integrally provided with projecting engaging portions on both outer side surfaces respectively, the lower component of the bobbin case includes a concave receiving portion receiving the pawl, grooves having guides guiding the projecting engaging portions provided on the pawl thereby bending the pawl and stop portions fixing the projecting engaging portions upon restoration of the bent pawl are provided on both inner side surfaces of the concave receiving portion respectively and chamfers are provided around the inlets of the guides of the grooves so that the upper component and the lower component are fixed to each other without protruding the outer surface of the pawl beyond the outer surface of the bobbin case while the pawl is inserted into the concave receiving portion and the projecting engaging portions provided on the pawl are fixed by the stop portions.

In the ink sheet cartridge according to the second aspect of the present invention, as hereinabove described, the upper component of the bobbin case includes the pawl provided with the projecting engaging portions on the outer side surfaces thereof and the lower component of the bobbin case includes the concave receiving portion receiving the pawl while the grooves having the guides guiding the projecting engaging portions provided on the pawl thereby bending the pawl and the stop portions fixing the projecting engaging portions upon restoration of the bent pawl are provided on the inner side surfaces of the concave receiving portion so that the projecting engaging portions are guided along the guides of the grooves to thereafter engage with the stop portions of the grooves when the upper and lower components are combined with each other, whereby the projecting engaging portions can be prevented from application of an excessive load. Further, the engagement between the projecting engaging portions and the stop portions can be canceled by separating the projecting engaging portions provided on the pawl from the stop portions provided on the side surfaces of the concave receiving portion by plunging the pawl, whereby the upper and lower components can be easily separated from each other. Thus, the bobbin case can be easily assembled and disassembled. In addition, the projecting engaging portions are so integrally provided on the side surfaces of the pawl provided on the upper component that the number of components can be inhibited from increase despite the provision of the projecting engaging portions. Further, the upper and lower components are fixed to each other without protruding the outer surface of the pawl beyond the outer surface of the bobbin case while the pawl is inserted into the concave receiving portion and the projecting engaging portions provided on the pawl are fixed by the stop portions of the grooves so that no protrusion is formed on the outer surface of the bobbin case, whereby the outer size of the bobbin case can be prevented from increase while no protrusion comes into contact with components provided in a printer. Further, the projecting engaging portions are provided on both outer side surfaces of the pawl respectively while the grooves are provided on both inner side surfaces of the concave receiving portion respectively, so that the pair of projecting engaging portions engage with the pair of grooves respectively. Thus, the pawl can be more stably guided along the guides of the grooves, and the projecting engaging portions can be more stably fixed by bringing the stop portions of the pair of grooves and the pair of projecting engaging portions into contact with each other. Further, the chamfers are so provided around the inlets of the guides of the grooves that the portions around the inlets of the guides of the grooves are widened, whereby the projecting engaging portions provided on the pawl can easily engage with the guides of the grooves provided on the side surfaces of the concave receiving portion. Thus, the bobbin case can be more easily assembled.

In the aforementioned ink sheet cartridge according to the second aspect, the upper component and the lower component are preferably so fixed to each other that the outer surface of the pawl is substantially flush with the outer surface of the lower component while the pawl is inserted into the concave receiving portion and the projecting engaging portions provided on the pawl are fixed by the stop portions. According to this structure, the outer surface of the pawl can be easily inhibited from protruding beyond the outer surface of the lower component so that no step is formed between the outer surfaces of the pawl and the lower component while the upper and lower components are fixed to each other.

In the ink sheet cartridge according to the second aspect, the projecting engaging portions provided on the pawl preferably engage with the stop portions of the grooves provided on the concave receiving portion in a state inwardly movable into the bobbin case. According to this structure, the projecting engaging portions can be easily moved into the bobbin case by externally plunging the pawl provided with the projecting engaging portions into the bobbin case in the state of the engagement between the projecting engaging portions and the stop portions of the grooves when separating the upper and lower components from each other.

In this case, the engagement between the engaging portions of the pawl and the stop portions of the grooves is preferably canceled by externally plunging the pawl into the bobbin case in the state of the engagement between the engaging portions and the stop portions. According to this structure, the engagement between the engaging portions and the stop portions can be easily canceled by externally plunging the pawl into the bobbin case when separating the upper and lower components from each other since the pawl can be more easily plunged into the bobbin case as compared with a case of pulling out the pawl from the bobbin case.

In this case, further, the upper component and the lower component are preferably separated from each other by moving at least either the upper component or the lower component to separate from either the lower component or the upper component after cancellation of the engagement between the engaging portions and the stop portions. According to this structure, the projecting engaging portions provided on the pawl of the upper component can be moved along the guides of the grooves provided on the concave receiving portion of the lower component when the engagement between the engaging portions and the stop portions is canceled, whereby at least either the upper component or the lower component can be easily separated from either the lower component or the upper component. Consequently, the upper and lower components can be easily separated from each other by moving at least either the upper component or the lower component to separate from either the lower component or the upper component.

In the aforementioned ink sheet cartridge according to the second aspect, the guides of the grooves and the stop portions of the grooves are preferably continuously formed. According to this structure, the guides and the stop portions of the grooves are so continuous that the projecting engaging portions can be easily moved from the guides of the grooves toward the stop portions of the grooves when combining the upper and lower components with each other and the projecting engaging portions can be easily moved from the stop portions of the grooves toward the guides of the grooves when separating the upper and lower components from each other.

In the aforementioned ink sheet cartridge including the grooves having the continuously formed guides and stop portions, the engaging portions of the pawl are preferably moved from the stop portions of the grooves toward the guides of the grooves by externally plunging the pawl into the bobbin case in the state where the pawl is inserted into the concave receiving portion for engaging the projecting engaging portions provided on the pawl and the stop portions of the grooves with each other. According to this structure, the engaging portions of the pawl can be more easily moved from the stop portions of the grooves toward the guides of the grooves when separating the upper and lower components from each other, whereby the engaging portions of the pawl can be easily moved along the guides of the grooves.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of an ink sheet cartridge 10 according to the embodiment of the present invention is described with reference to FIGS. 1 to 15.

Figure 1:
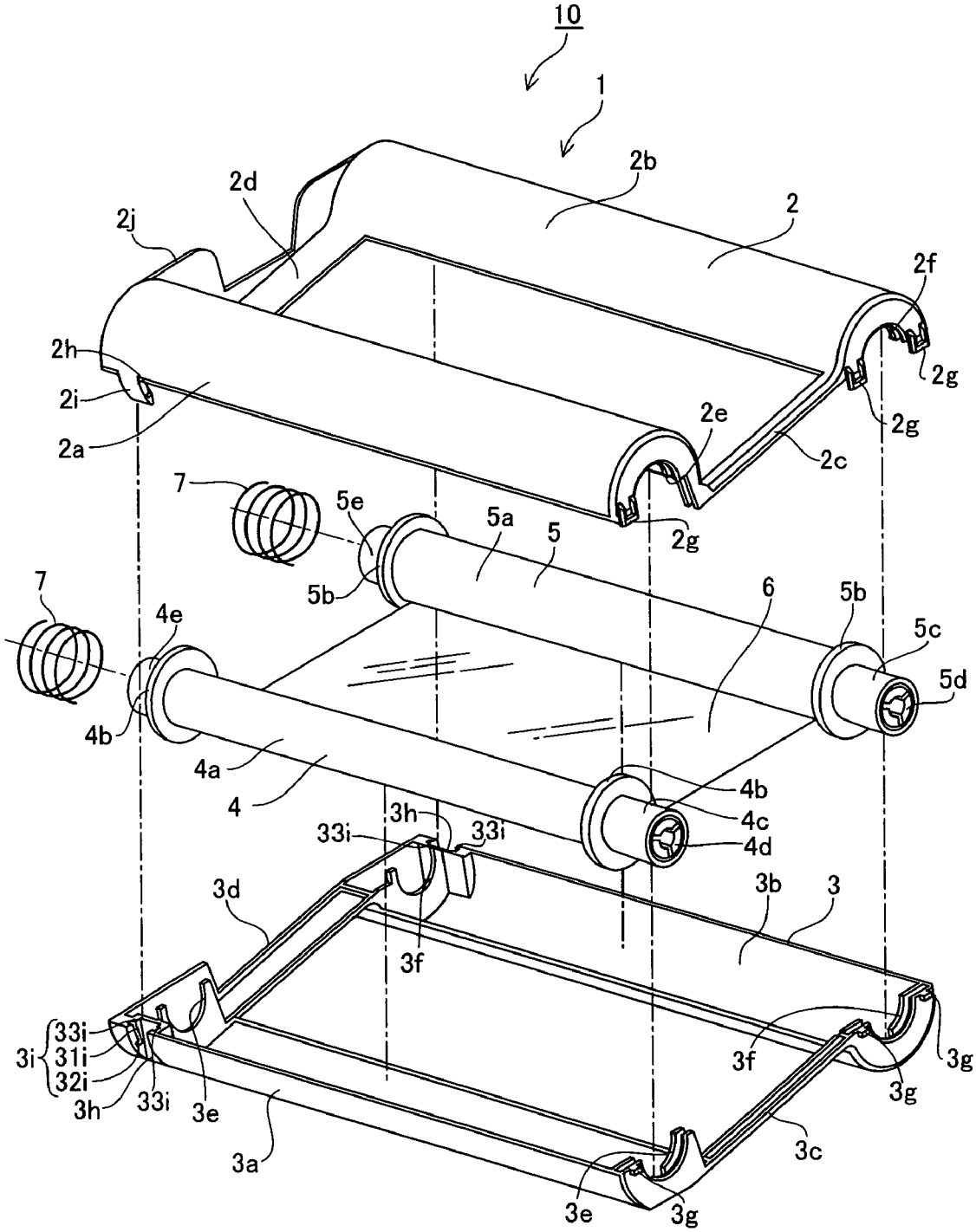
FIG. 1 is an exploded perspective view of an ink sheet cartridge according to an embodiment of the present invention.

As shown in FIG. 1, the ink sheet cartridge 10 according to the embodiment of the present invention comprises a resin upper component 2 and a resin lower component 3 constituting a bobbin case 1, a feed bobbin 4 feeding an ink sheet 6, a take-up bobbin 5 taking up the ink sheet 6, the ink sheet 6 and a compression coil spring 7 for urging the feed bobbin 4 and the take-up bobbin 5 toward an end of the bobbin case 1.

The upper component 2 constituting the bobbin case 1 includes a feed bobbin storage portion 2*a* storing the feed bobbin 4, a take-up bobbin storage portion 2*b* storing the take-up bobbin 5 and coupling portions 2*c* and 2*d* coupling the feed bobbin storage portion 2*a* and the take-up bobbin storage portion 2*b* with each other, as shown in FIG. 1. A reinforcing portion 2*j* for preventing the ink sheet cartridge 10 from twisting resulting from a load applied in printing is provided on the coupling portion 2*d* of the upper component 2, to extend perpendicularly to the surface of the coupling portion 2*d*. Feed bobbin holding portions 2*e* rotatably holding the feed bobbin 4 are provided in the feed bobbin storage portion 2*a*, while take-up bobbin holding portions 2*f* rotatably holding the take-up bobbin 5 are provided in the take-up bobbin storage portion 2*b*. Three U-shaped engaging portions 2*g* for fixing the lower component 3 are provided on first end surfaces of the feed bobbin storage portion 2*a* and the take-up bobbin storage portion 2*b* of the upper component 2. Further, two downwardly projecting pawls 2*h* for fixing the lower component 3 are provided on portions close to second ends of the feed bobbin storage portion 2*a* and the take-up bobbin storage portion 2*b* of the upper component 2.

Figure 2:
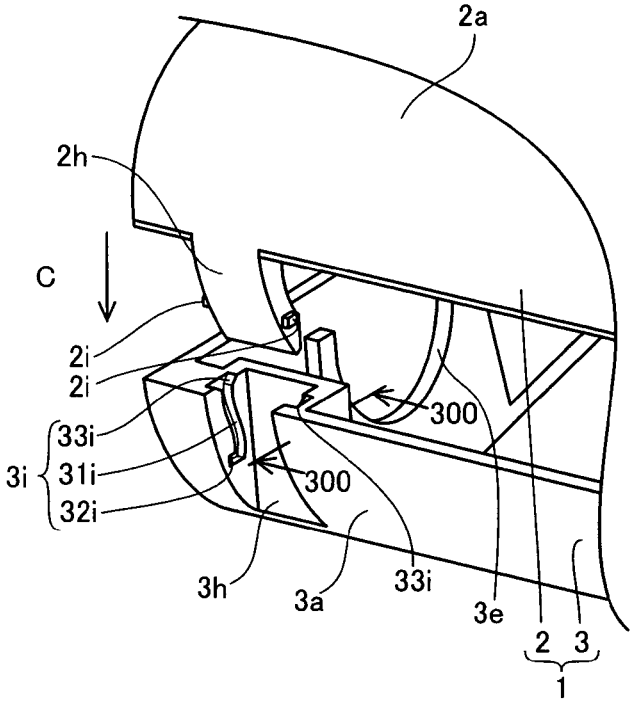
FIG. 2 detailedly illustrates a fixing portion of the ink sheet cartridge according to the embodiment of the present invention shown in FIG. 1.
Figure 8:
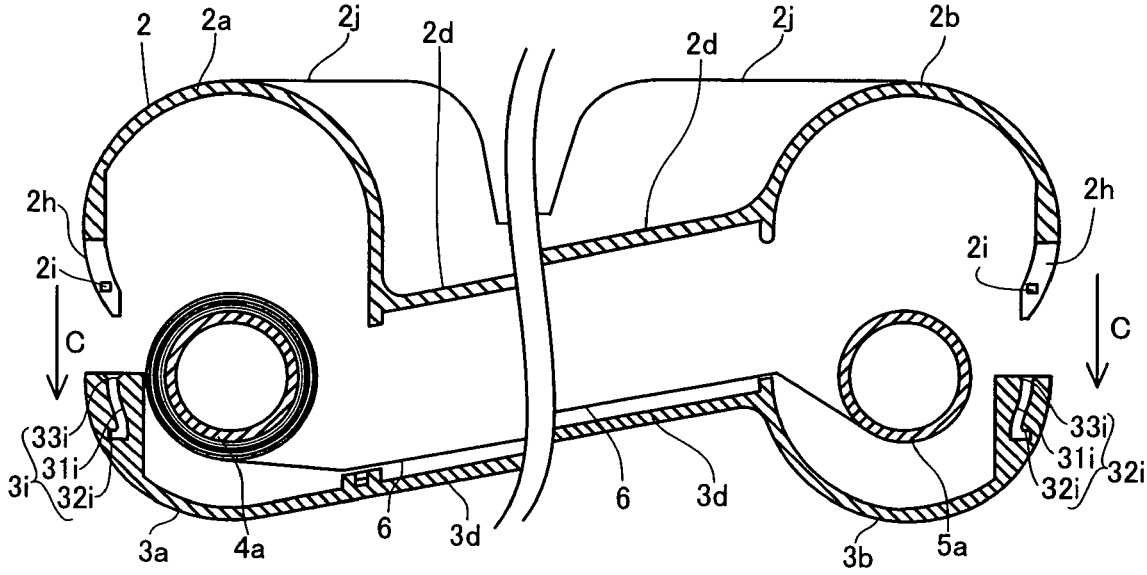
FIGS. 8 and 9 are sectional views taken along the line 500-500 in FIG. 5.
Figure 9:
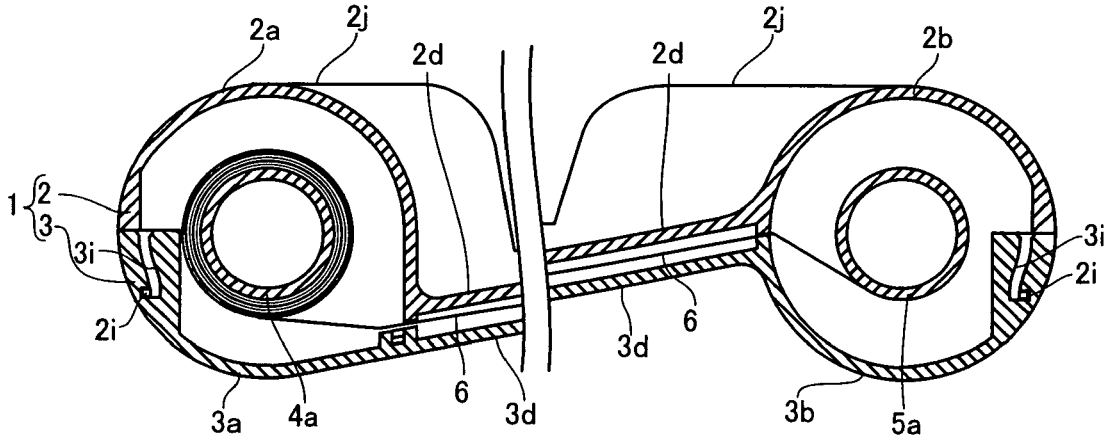

In the ink sheet cartridge 10 according to this embodiment, pairs of projecting engaging portions 2*i* are integrally provided on both outer side surfaces of the pawls 2*h* provided on the upper component 2 respectively, as shown in FIGS. 2 and 8.

Figure 5:
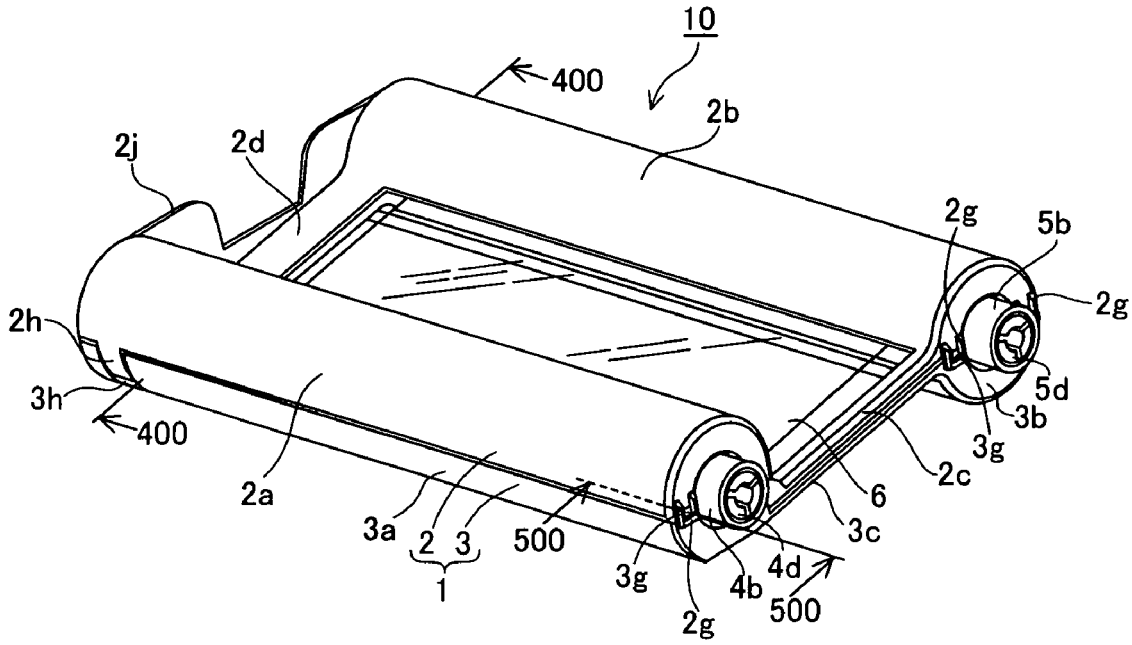
FIG. 5 is an overall perspective view of the ink sheet cartridge according to the embodiment of the present invention shown in FIG. 1.

According to this embodiment, the pawls 2*h* are so formed that the outer surfaces thereof are flush with the outer surface of the lower component 3 of the bobbin case 1 when the upper and lower components 2 and 3 are fixed to each other, as shown in FIG. 5.

As shown in FIG. 1, the lower component 3 constituting the bobbin case 1 includes a feed bobbin storage portion 3*a* storing the feed bobbin 4, a take-up bobbin storage portion 3*b* storing the take-up bobbin 5 and coupling portions 3*c* and 3*d* coupling the feed bobbin storage portion 3*a* and the take-up bobbin storage portion 3*b* with each other, similarly to the upper component 2. Feed bobbin support portions 3*e* rotatably supporting the feed bobbin 4 are provided in the feed bobbin storage portion 3*a*, while take-up bobbin support portions 3*f* rotatably supporting the take-up bobbin 5 are provided in the take-up bobbin storage portion 3*b*. Three protrusions 3*g* engaging with the three U-shaped engaging portions 2*g* of the upper component 2 are provided on first end surfaces of the feed bobbin storage portion 3*a* and the take-up bobbin storage portion 3*b* of the lower component 3. Two receiving portions 3*h* receiving the two pawls 2*h* of the upper component 2 are provided on portions close to second ends of the feed bobbin storage portion 3*a* and the take-up bobbin storage portion 3*b* of the lower component 3.

Figure 3:
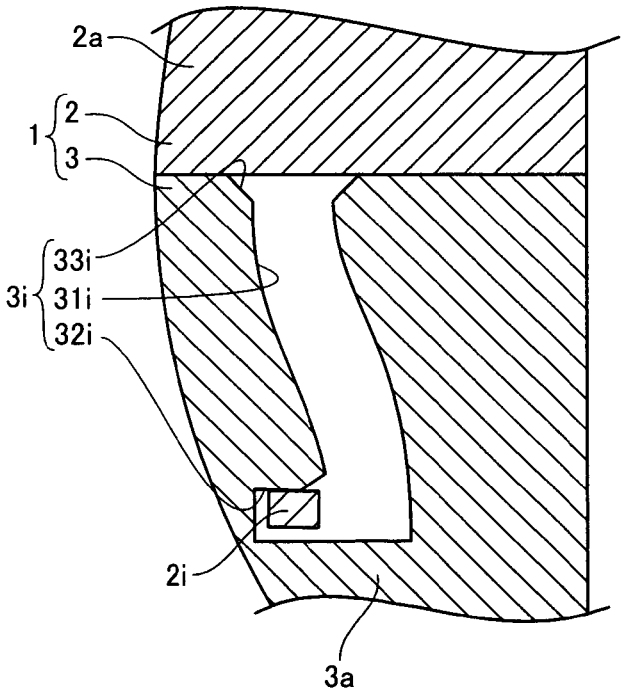
FIG. 3 is a sectional view taken along the line 300-300 in FIG. 2.
Figure 7:
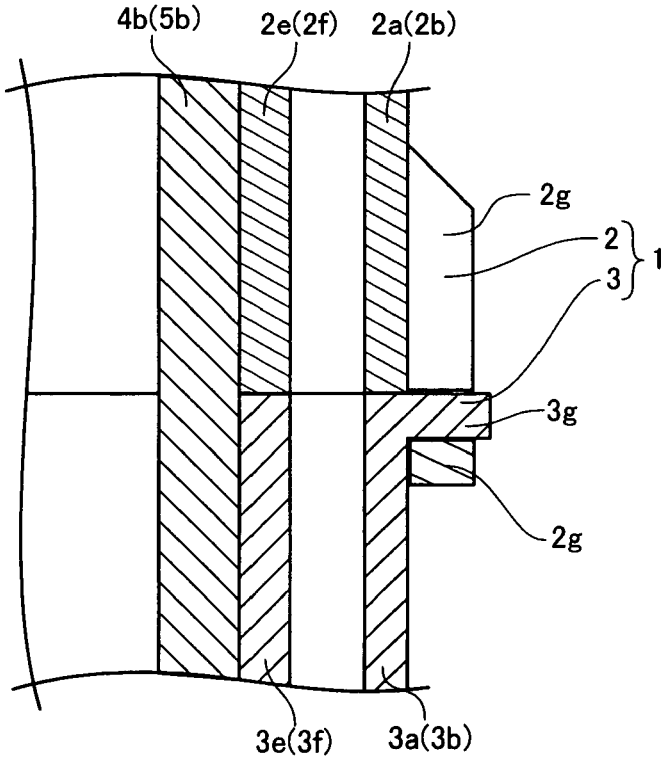
FIG. 7 is a sectional view taken along the line 400-400 in FIG. 5.

In the ink sheet cartridge 10 according to this embodiment, grooves 3*i* are provided on both inner side surfaces of the concave receiving portions 3*h* provided on the lower component 3 respectively, as shown in FIGS. 2, 3 and 7. The grooves 3*i* include guides 31*i* guiding the projecting engaging portions 2*i* provided on the pawls 2*h* thereby bending the pawls 2*h* and stop portions 32*i* fixing the projecting engaging portions 2*i* upon restoration of the bent pawls 2*h*. Chamfers 33*i* are provided around the inlets of the grooves 3*i*.

As shown in FIG. 1, the feed bobbin 4 is provided with a sheet feed shaft 4*a* wound with the ink sheet 6 to be fed, flanges 4*b*, a drive shaft 4*c*, an engaging portion 4*d*, provided on the drive shaft 4*c*, having three recess portions engaging with bobbin drive reels of a printer (not shown) and a follower shaft 4*e*.

The take-up bobbin 5 is provided with a sheet take-up shaft 5*a* taking up the ink sheet 6 fed from the feed bobbin 4, flanges 5*b*, a drive shaft 5*c*, an engaging portion 5*d*, provided on the drive shaft 5*c*, having three recess portions engaging with bobbin drive reels of the printer (not shown) and a follower shaft 5*e*.

Figure 4:
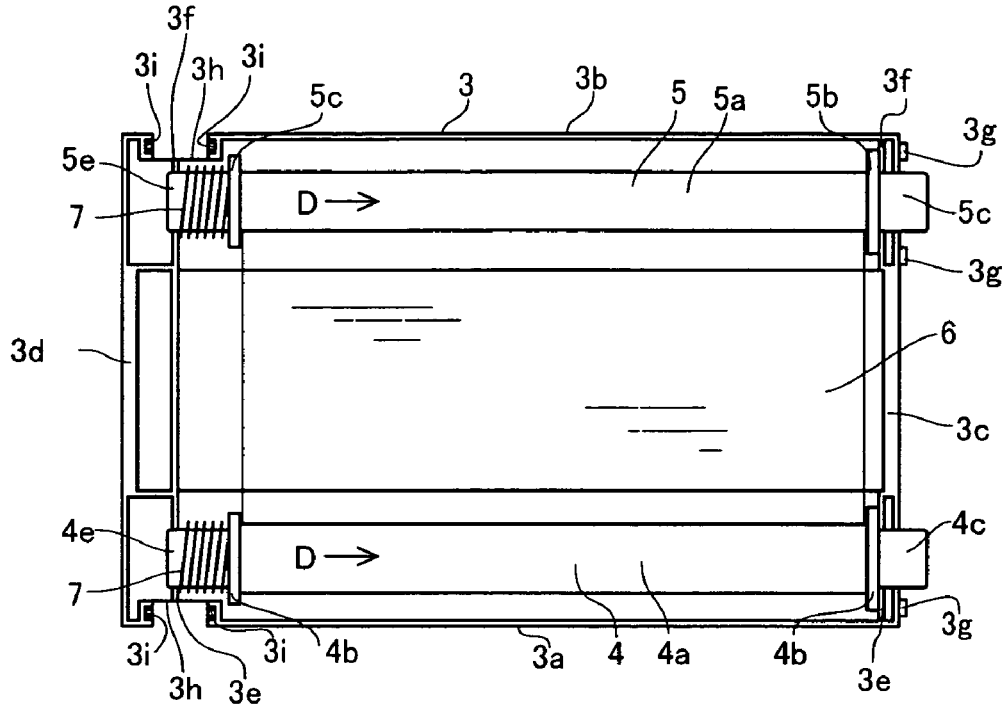
FIG. 4 is a plan view showing a feed bobbin and a take-up bobbin arranged on a lower component.

In the ink sheet cartridge 10 according to this embodiment, the feed bobbin 4 is arranged on the feed bobbin support portions 3*e* of the lower component 3 and the take-up bobbin 5 is arranged on the take-up bobbin support portions 3*f* of the lower component 3, as shown in FIGS. 1, 4 and 5. Compression coil springs 7 are mounted on the follower shafts 4*e* and 5*e* of the feed bobbin 4 and the take-up bobbin 5 respectively, thereby urging the feed bobbin 4 and the take-up bobbin 5 toward the end of the bobbin case 1 respectively. The upper and lower components 2 and 3 are fixed to each other in this state, thereby assembling the ink sheet cartridge 10 according to this embodiment. In this assembled state of the ink sheet cartridge 10, the feed bobbin 4 is unprotrusively arranged due to the flanges 4*b* coming into contact with the feed bobbin holding portions 2*e* and the feed bobbin support portions 3*e* in the bobbin case 1, while the take-up bobbin 5 is also unprotrusively arranged due to the flanges 5*b* coming into contact with the take-up bobbin holding portions 2*f* and the take-up bobbin support portions 3*f* in the bobbin case 1, similarly to the feed bobbin 4. Further, the compression coil springs 7 urge the feed bobbin 4 and the take-up bobbin 5 along arrow D respectively, as shown in FIG. 4.

Figure 6:
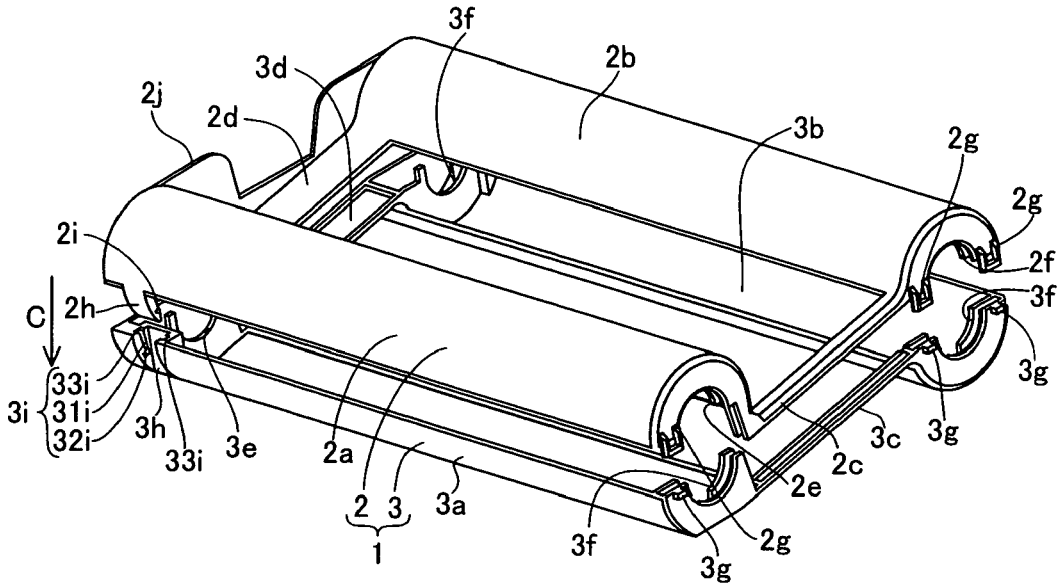
FIG. 6 is a perspective view of the ink sheet cartridge according to the embodiment of the present invention shown in FIG. 1, from which an ink sheet bobbin is removed.
Figure 10:
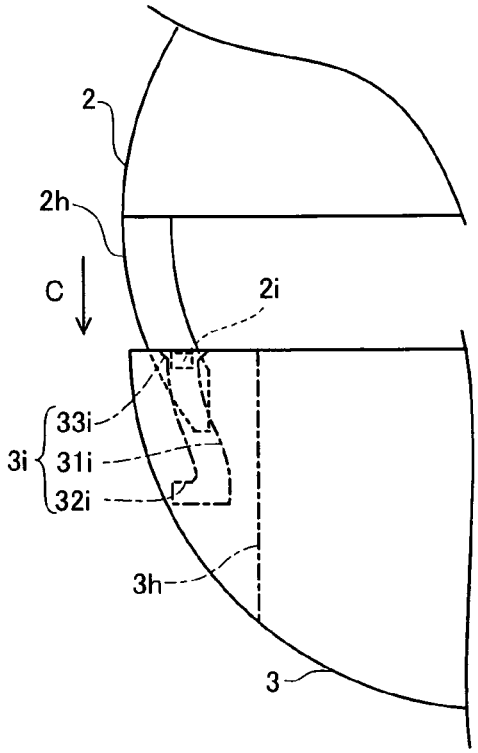
FIGS. 10 to 15 are diagrams for detailedly illustrating operations of the fixing portion of the ink sheet cartridge according to the embodiment of the present invention shown in FIG. 1.
Figure 11:
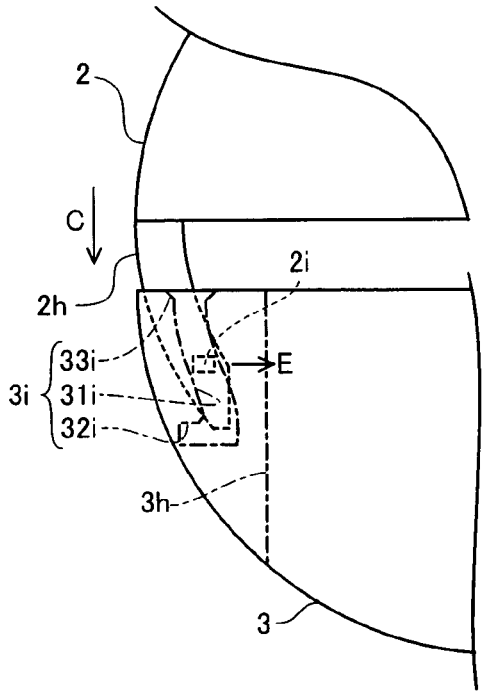
Figure 12:
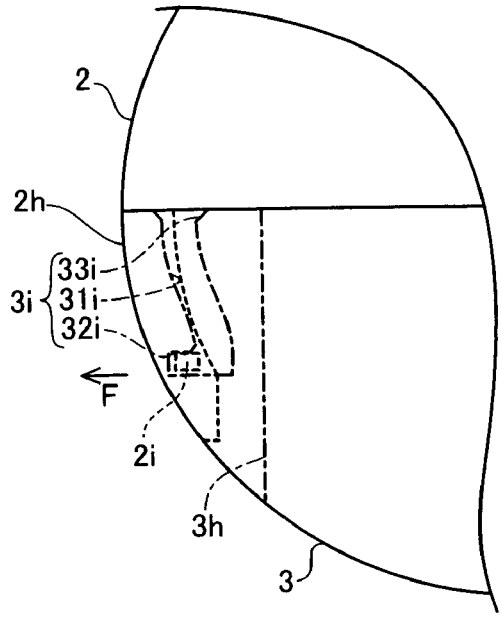

Methods of combining and separating the upper and lower components 2 and 3 of the ink sheet cartridge 10 according to this embodiment with and from each other are now described with reference to FIGS. 6 to 15. First, the three U-shaped engaging portions 2*g* of the upper component 2 are engaged with the three protrusions 3*g* of the lower component 3, as shown in FIGS. 6 and 7. Thereafter the pawls 2*h* of the upper component 2 are moved along arrow C in FIGS. 6, 8, 10 and 11, to be inserted into the concave receiving portions 3*h* of the lower component 3. In this state, the pair of projecting engaging portions 2*i* provided on both outer side surfaces of each pawl 2*h* are positioned around the inlets of the guides 31*i* of the pair of grooves 3*i* provided on both inner side surfaces of the corresponding concave receiving portion 3*h*, as shown in FIG. 10. When each pawl 2*h* is moved along arrow C in FIG. 10 and inserted into the corresponding concave receiving portion 3*h*, the projecting engaging portions 2*i* provided on the pawl 2*h* are guided along the guides 31*i* of the grooves 3*i* along arrow E, as shown by arrow E in FIG. 11. Thus, the pawl 2*h* is bent. When the pawl 2*h* is further moved along arrow C in FIG. 11 and inserted into the receiving portion 3*h*, the projecting engaging portions 2*i* thereof reach ends of the guides 31*i*, to be guided along arrow F in FIG. 12. Therefore, the bent pawl 2*h* is so restored that the projecting engaging portions 2*i* come into contact with the stop portions 32*i* of the grooves 3*i*. In this state, the upper and lower components 2 and 3 are fixed to each other to assemble the bobbin case 1, as shown in FIG. 5.

Figure 13:
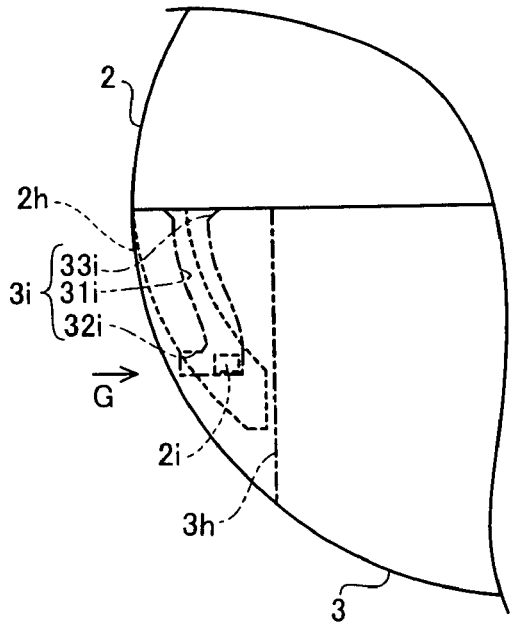
Figure 14:
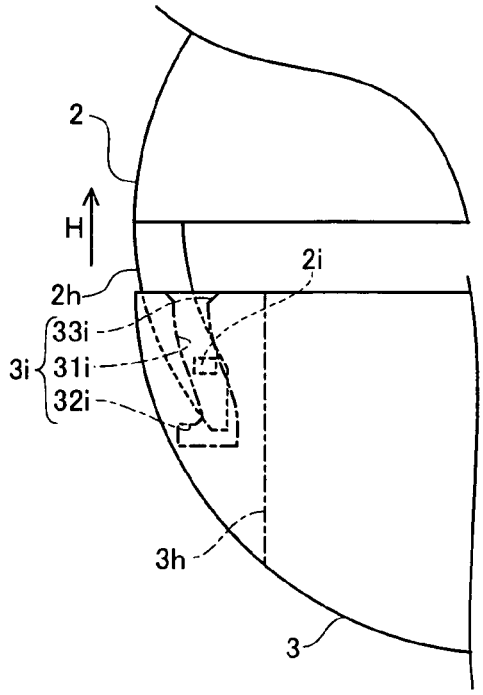
Figure 15:
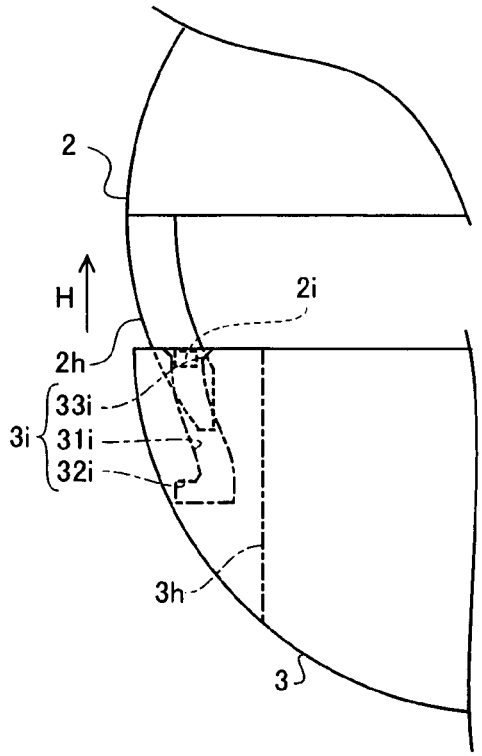
Figure 16:
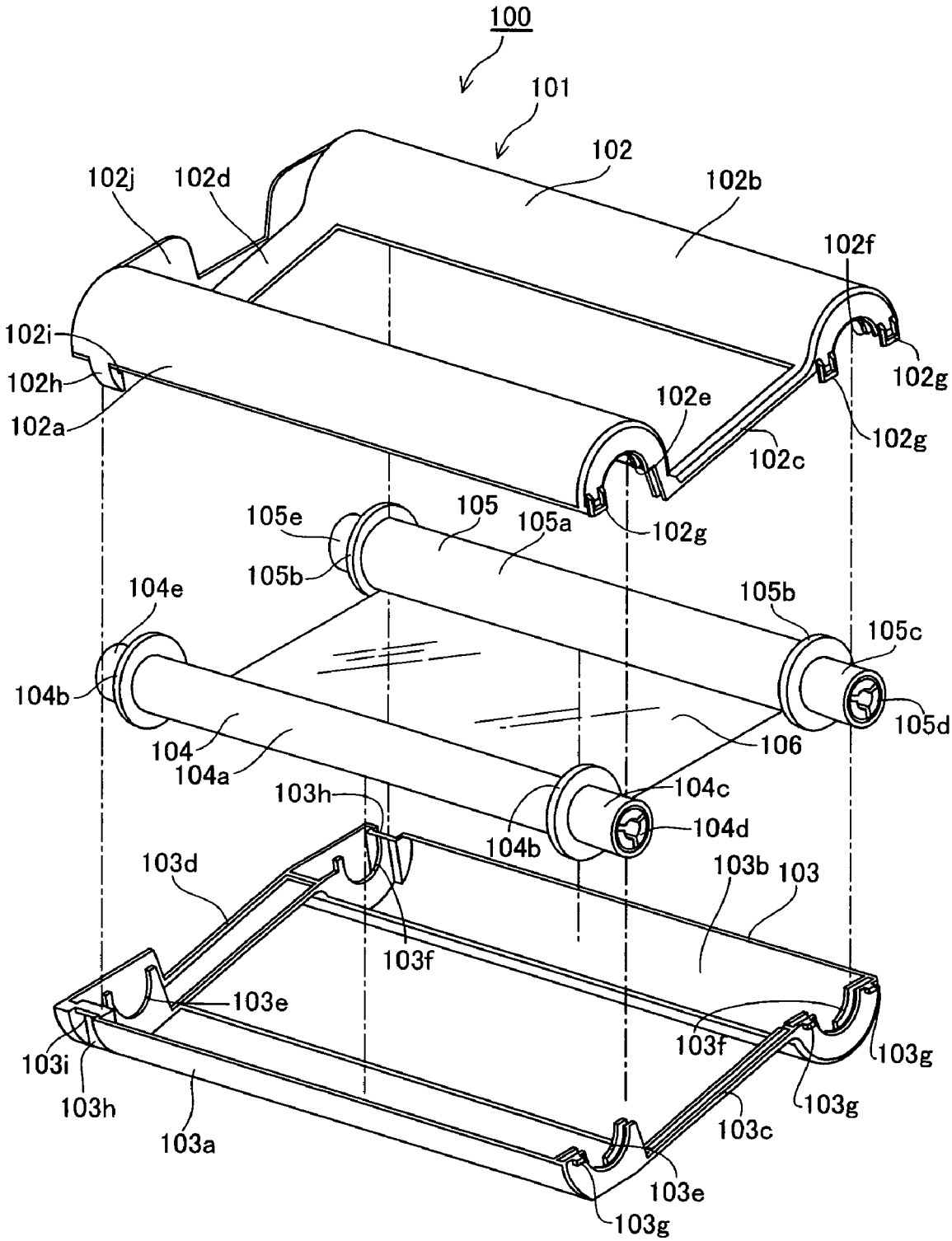
FIG.16 PRIOR ART
FIG. 16 is an exploded perspective view of a conventional ink sheet cartridge.
Figure 17:
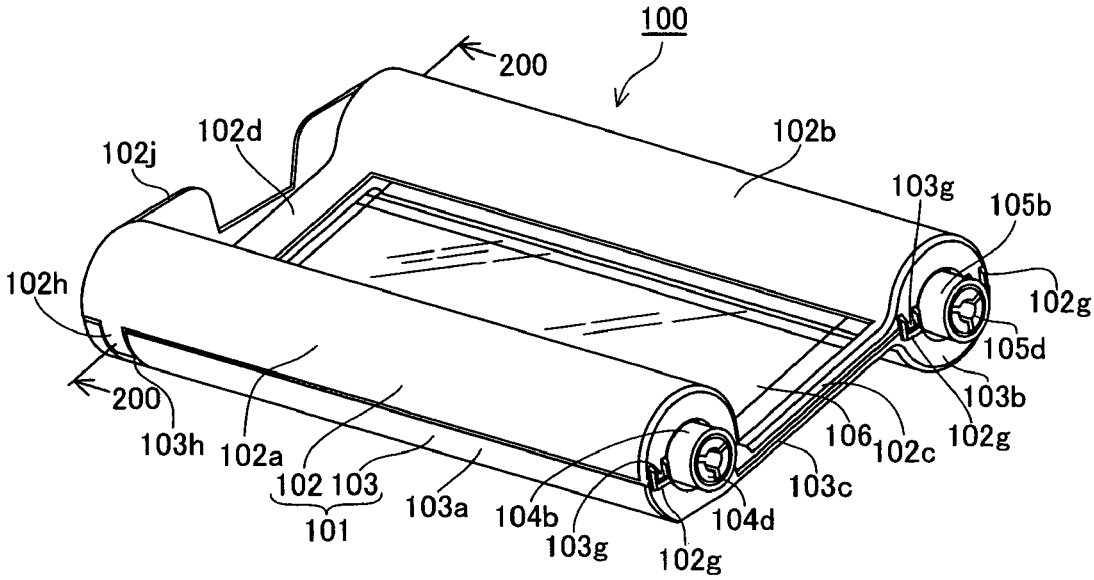
FIG.17 PRIOR ART
FIG. 17 is an overall perspective view of the conventional ink sheet cartridge.
Figure 18:
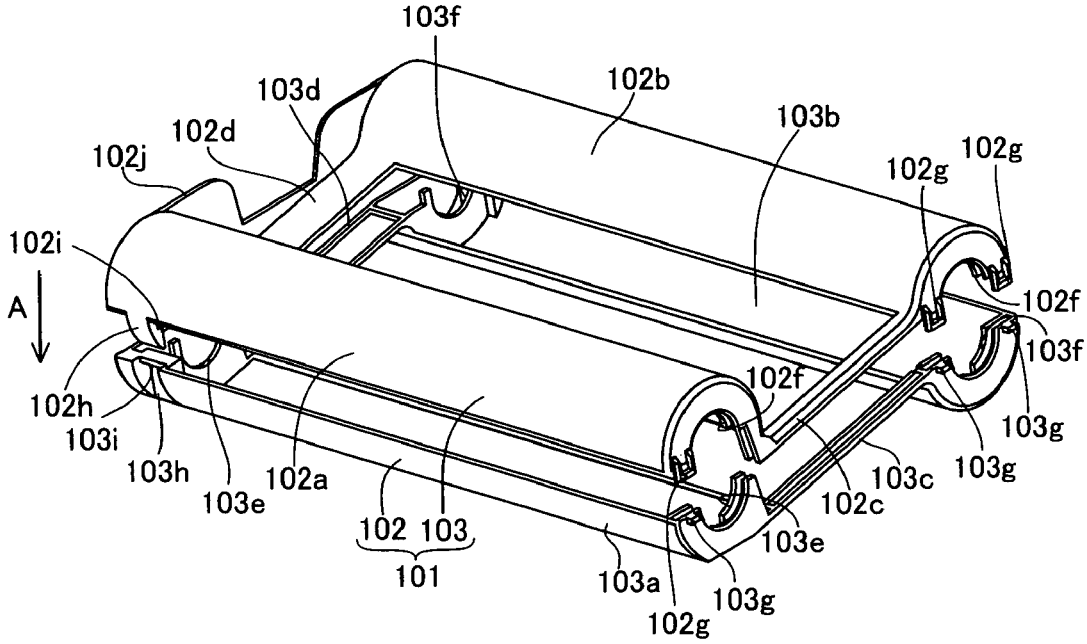
FIG.18 PRIOR ART
FIG. 18 is a perspective view of the conventional ink sheet cartridge, from which an ink sheet bobbin is removed.
Figure 19:
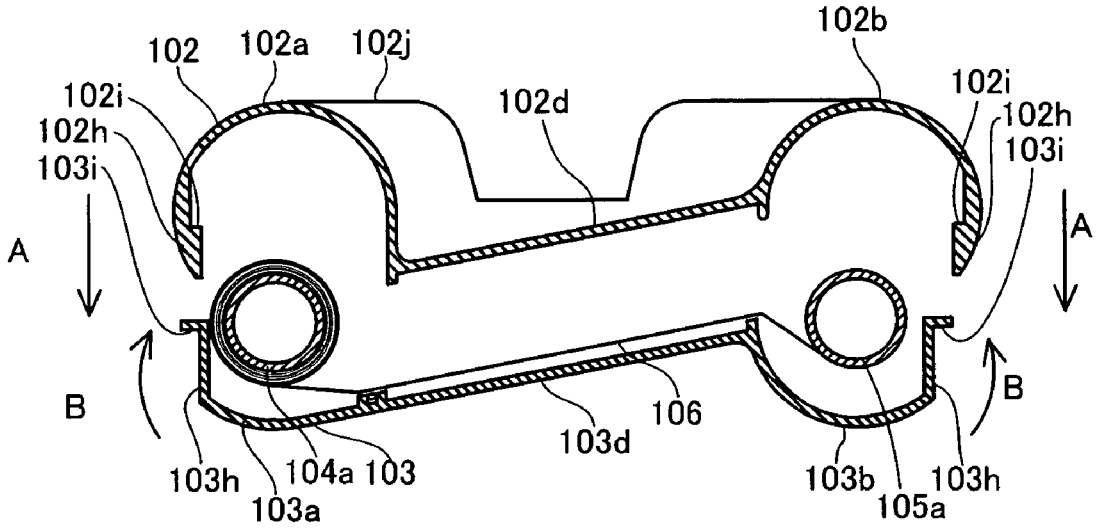
FIG.19 PRIOR ART
FIGS. 19 and 20 are sectional views taken along the line 200-200 in FIG. 17.
Figure 20:
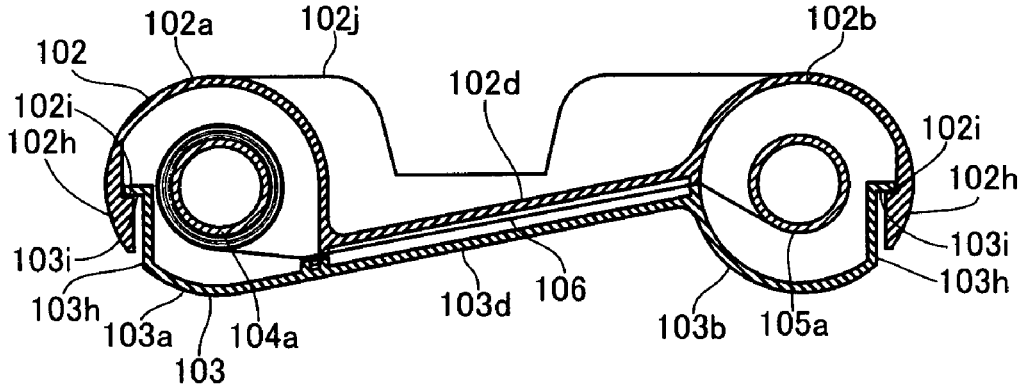
FIG.20 PRIOR ART
Figure 21:
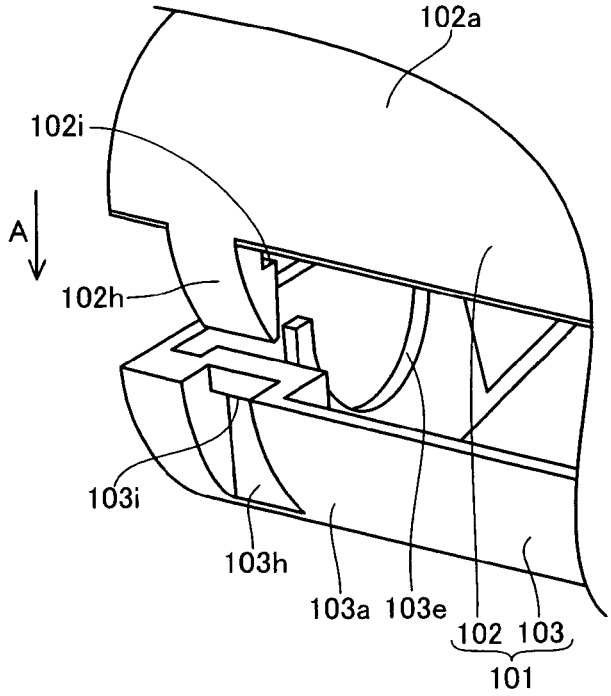
FIG.21 PRIOR ART
FIG. 21 detailedly illustrates a fixing portion of the conventional ink sheet cartridge.
Figure 22:
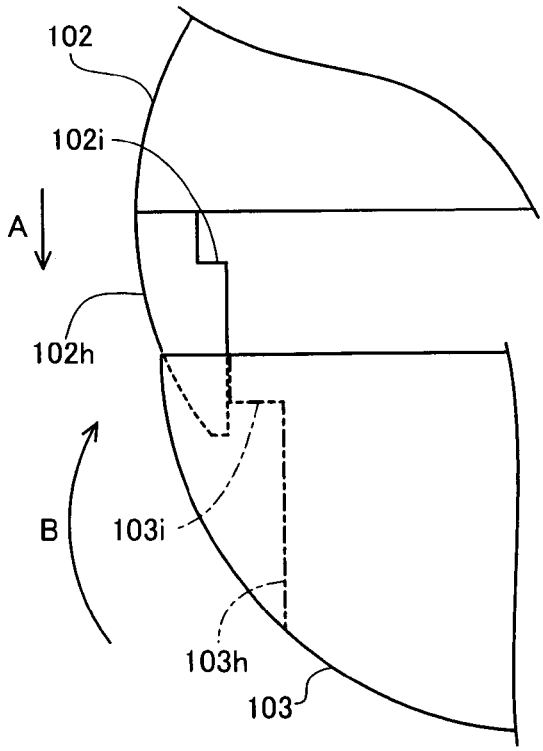
FIG.22 PRIOR ART
FIGS. 22 and 23 are diagrams for detailedly illustrating operations of the fixing portion of the conventional ink sheet cartridge.
Figure 23:
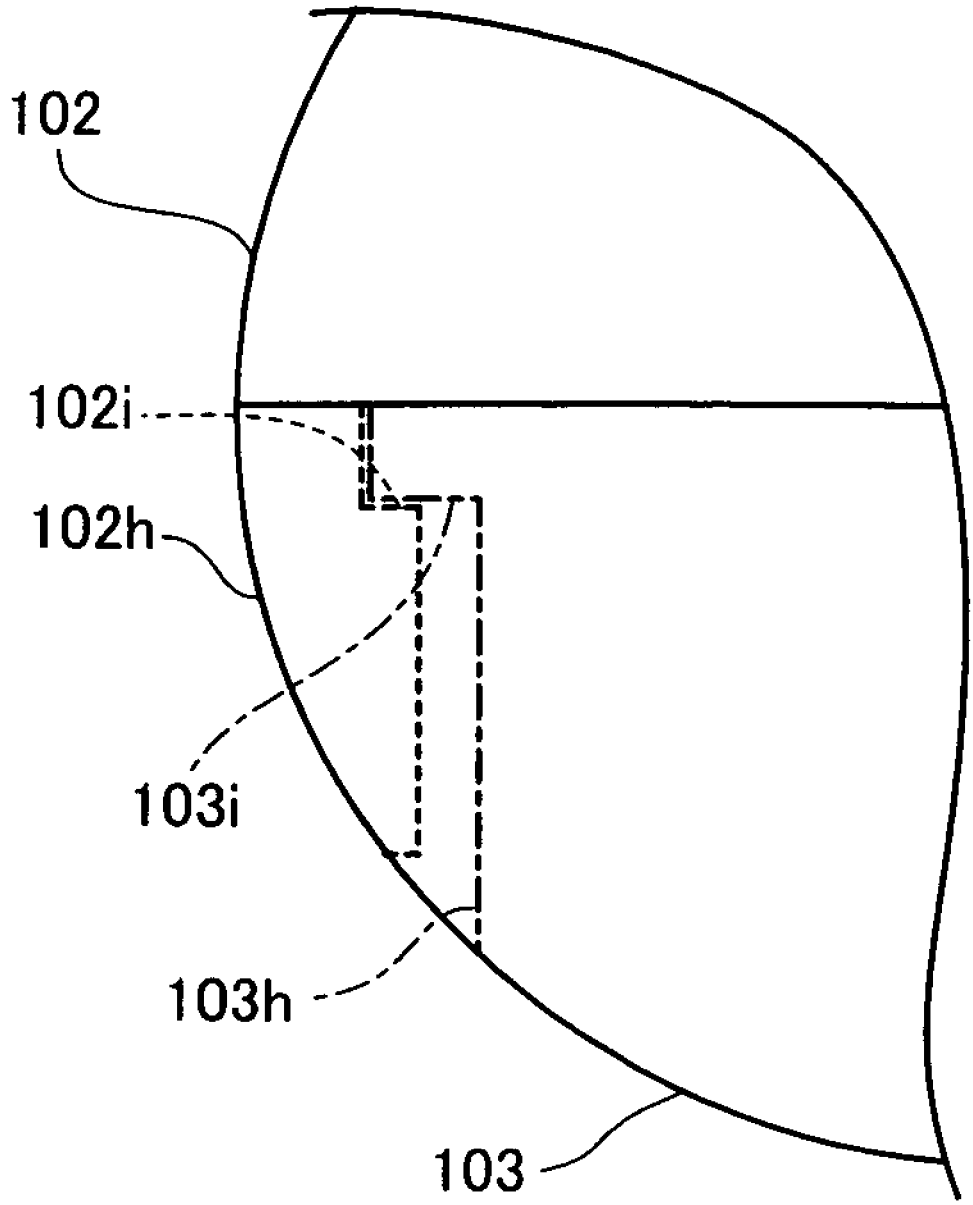
FIG.23 PRIOR ART

In order to disassemble the bobbin case 1, each pawl 2*h* is plunged along arrow G in FIG. 13, thereby disengaging the projecting engaging portions 2*i* provided on the pawl 2*h* and the stop portions 32*i* of the grooves 3*i* from each other. In this state, the upper component 2 is lifted up along arrow H shown in FIG. 14, so that the projecting engaging portions 2*i* move upward along the guides 31*i* of the grooves 3*i*. The upper component 2 is further lifted up along arrow H shown in FIG. 15, thereby separating the upper and lower components 2 and 3 from each other.

According to this embodiment, as hereinabove described, the upper component 2 of the bobbin case 1 includes the pawls 2*h* provided with the projecting engaging portions 2*i* on the outer side surfaces thereof while the lower component 3 of the bobbin case 1 includes the concave receiving portions 3*h* receiving the pawls 2*h*, and the grooves 3*i* having the guides 31*i* guiding the projecting engaging portions 2*i* provided on the pawls 2*h* thereby bending the pawls 2*h* and the stop portions 32*i* fixing the projecting engaging portions 2*i* upon restoration of the bent pawls 2*h* are provided on the inner side surfaces of the concave receiving portions 3*h* so that the projecting engaging portions 2*i* are guided along the guides 31*i* of the grooves 3*i* to thereafter engage with the stop portions 32*i* of the grooves 3*i* for combining the upper and lower components 2 and 3 with each other, whereby the projecting engaging portions 2*i* can be prevented from application of an excessive load. Further, the engagement between the projecting engaging portions 2*i* provided on the pawls 2*h* and the stop portions 32*i* of the grooves 3*i* provided on the side surfaces of the concave receiving portions 3*h* can be canceled by plunging the pawls 2*h* thereby separating the projecting engaging portions 2*i* from the stop portions 32*i*, whereby the upper and lower components 2 and 3 can be easily separated from each other. Thus, the bobbin case 1 can be easily assembled and disassembled.

According to this embodiment, the projecting engaging portions 2*i* are integrally provided on the side surfaces of the pawls 2*h* provided on the upper component 2, whereby the number of components can be inhibited from increase despite the provision of the projecting engaging portions 2*i*.

According to this embodiment, the pawls 2*h* are inserted into the concave receiving portions 3*h* and the projecting engaging portions 2*i* provided on the pawls 2*h* are fixed by the stop portions 31*i* of the grooves 3*i* for fixing the upper and lower components 2 and 3 to each other without protruding the outer surfaces of the pawls 2*h* beyond the outer surface of the lower component of the bobbin case 1 so that no protrusions are formed on the outer surface of the bobbin case 1, whereby the outer size of the bobbin case 1 can be prevented from increase and no protrusions come into contact with components in the printer (not shown).

According to this embodiment, the projecting engaging portions 2*i* are provided on both side surfaces of the pawls 2*h* respectively while the grooves 3*i* are provided on both inner side surfaces of the concave receiving portions 3*h* respectively so that the pairs of projecting engaging portions 2*i* engage with the pairs of grooves 3*i* respectively. Therefore, the pawls 2*h* can be more stably guided along the guides 31*i* of the grooves 3*i*, and the projecting engaging portions 2*i* can be more stably fixed by bringing the stop portions 32*i* of the pairs of grooves 3*i* and the pairs of projecting engaging portions 2*i* into contact with each other.

According to this embodiment, the chamfers 33*i* are so provided around the inlets of the guides 31*i* of the grooves 3*i* as to widen the portions around the inlets of the guides 31*i* of the grooves 3*i*, whereby the projecting engaging portions 2*i* provided on the pawls 2*h* can be easily engaged with the guides 31*i* of the grooves 3*i* provided on the side surfaces of the concave receiving portions 3*h*. Thus, the bobbin case 1 can be more easily assembled.

Although the present invention has been described and illustrated in detail, it is clearly understood that the same is by way of illustration and example only and is not to be taken by way of limitation, the spirit and scope of the present invention being limited only by the terms of the appended claims.

For example, while the upper component of the bobbin case includes the pawls provided with the projecting engaging portions and the lower component includes the concave receiving portions provided with the grooves in the aforementioned embodiment, the present invention is not restricted to this but the upper component may alternatively include concave receiving portions provided with grooves, so that the lower component includes pawls provided with projecting engaging portions.

While the projecting engaging portions are provided on the side surfaces of the pawls and the grooves are provided on the side surfaces of the concave receiving portions in the aforementioned embodiment, the present invention is not restricted to this but the projecting engaging portions may alternatively be provided on portions other than the pawls, and the grooves may alternatively be provided on portions other than the concave receiving portions.

While the projecting engaging portions are provided on both side surfaces of the pawls respectively and the grooves are provided on both side surfaces of the concave receiving portions respectively in the aforementioned embodiment, the present invention is not restricted to this but the projecting engaging portions and the grooves may alternatively be provided only on first side surfaces of the pawls and the concave receiving portions respectively.

While the pawls are so formed that the outer surfaces thereof are flush with the outer surface of the bobbin case when the upper and lower components are fixed to each other in the aforementioned embodiment, the present invention is not restricted to this but the pawls may not be flush with the bobbin case so far as the former do not protrude from the latter.

What is claimed is:

1. An ink sheet cartridge comprising:

an ink sheet for printing;

a feed bobbin wound with said ink sheet;

a take-up bobbin for taking up said ink sheet; and a bobbin case, constituted of an upper component and a lower component in a vertically dividable manner, rotatably storing said feed bobbin and said take-up bobbin, wherein a pawl is integrally provided with a projecting engaging portion on an outer side surface of either said upper component or said lower component, a groove having a guide for guiding said projecting engaging portion thereby bending said pawl and a stop portion fixing said projecting engaging portion upon restoration of the bending of said pawl is provided on either said lower component or said upper component, and said projecting engaging portion is formed to project from an outer side surface of said pawl in a direction perpendicular to a bending direction of said pawl.

2. The ink sheet cartridge according to claim 1, wherein said upper component includes a pawl provided with said projecting engaging portion on the outer side surface thereof, said lower component includes a concave receiving portion receiving said pawl, and said groove is provided on the inner side surface of said concave receiving portion.

3. The ink sheet cartridge according to claim 2, wherein said upper component and said lower component are fixed to each other without protruding the outer surface of said pawl beyond the outer surface of said bobbin case while said pawl is inserted into said concave receiving portion and said projecting engaging portion provided on said pawl is fixed by said stop portion.

4. The ink sheet cartridge according to claim 3, wherein said upper component and said lower component are so fixed to each other that the outer surface of said pawl is substantially flush with the outer surface of said lower component while said pawl is inserted into said concave receiving portion and said projecting engaging portion provided on said pawl is fixed by said stop portion.

5. The ink sheet cartridge according to claim 2, wherein said projecting engaging portion is provided on each of both outer side surfaces of said pawl, and said groove is provided on each of both inner side surfaces of said concave receiving portion.

6. The ink sheet cartridge according to claim 1, wherein a chamfer is provided around the inlet of said guide of said groove.

7. The ink sheet cartridge according to claim 2, wherein said projecting engaging portion provided on said pawl engages with said stop portion of said groove provided on said concave receiving portion in a state inwardly movable into said bobbin case.

8. The ink sheet cartridge according to claim 7, wherein the engagement between said engaging portion of said pawl and said stop portion of said groove is canceled by externally plunging said pawl into said bobbin case in the state of the engagement between said engaging portion and said stop portion.

9. The ink sheet cartridge according to claim 8, wherein said upper component and said lower component are separated from each other by moving at least either said upper component or said lower component to separate from either said lower component or said upper component after cancellation of the engagement between said engaging portion and said stop portion.

10. The ink sheet cartridge according to claim 1, wherein said guide of said groove and said stop portion of said groove are continuously formed.

11. The ink sheet cartridge according to claim 10, wherein said engaging portion of said pawl is moved from said stop portion of said groove toward said guide of said groove by externally plunging said pawl into said bobbin case in the state where said pawl is inserted into said concave receiving portion for engaging said projecting engaging portion provided on said pawl and said stop portion of said groove with each other.

12. An ink sheet cartridge comprising:

an ink sheet for printing;

a feed bobbin wound with said ink sheet;

a take-up bobbin for taking up said ink sheet; and a bobbin case, constituted of an upper component and a lower component in a vertically dividable manner, rotatably storing said feed bobbin and said take-up bobbin, wherein said upper component of said bobbin case includes a pawl integrally provided with projecting engaging portions on both outer side surfaces respectively, said lower component of said bobbin case includes a concave receiving portion receiving said pawl, grooves having guides guiding said projecting engaging portions provided on said pawl thereby bending said pawl and stop portions fixing said projecting engaging portions upon restoration of the bending of said pawl are provided on both inner side surfaces of said concave receiving portion respectively, chamfers are provided around the inlets of said guides of said grooves, so that said upper component and said lower component are fixed to each other without protruding the outer surface of said pawl beyond the outer surface of said bobbin case while said pawl is inserted into said concave receiving portion and said projecting engaging portions provided on said pawl are fixed by said stop portions, and said projecting engaging portions are formed to project from said outer side surfaces of said pawl in a direction perpendicular to a bending direction of said pawl.

13. The ink sheet cartridge according to claim 12, wherein said upper component and said lower component are so fixed to each other that the outer surface of said pawl is substantially flush with the outer surface of said lower component while said pawl is inserted into said concave receiving portion and said projecting engaging portions provided on said pawl are fixed by said stop portions.

14. The ink sheet cartridge according to claim 12, wherein said projecting engaging portions provided on said pawl engage with said stop portions of said grooves provided on said concave receiving portion in a state inwardly movable into said bobbin case.

15. The ink sheet cartridge according to claim 14, wherein the engagement between said engaging portions of said pawl and said stop portions of said grooves is canceled by externally plunging said pawl into said bobbin case in the state of the engagement between said engaging portions and said stop portions.

16. The ink sheet cartridge according to claim 15, wherein said upper component and said lower component are separated from each other by moving at least either said upper component or said lower component to separate from either said lower component or said upper component after cancellation of the engagement between said engaging portions and said stop portions.

17. The ink sheet cartridge according to claim 12, wherein said guides of said grooves and said stop portions of said grooves are continuously formed.

18. The ink sheet cartridge according to claim 17, wherein said engaging portions of said pawl from said stop portions of said grooves are moved toward said guides of said grooves by externally plunging said pawl into said bobbin case in the state where said pawl is inserted into said concave receiving portion for engaging said projecting engaging portions provided on said pawl and said stop portions of said grooves with each other.

19. The ink sheet cartridge according to claim 1, wherein:

said guide inclines toward a first direction;

said stop portion is formed to extend from said guide toward a second direction opposite to said first direction;

said guide guides said engaging portion of said pawl bendable by deflection, so that said pawl is bent by deflecting said pawl in said first direction by a prescribed quantity; and said pawl is restored in said second direction by said prescribed quantity to cancel the bending of said prescribed quantity in said first direction, so that said engaging portion moves to said stop portion extending from said guide in said second direction to be fixed.

20. The ink sheet cartridge according to claim 12, wherein:

said guides incline toward a first direction;

said stop portions are formed to extend from said guides toward a second direction opposite to said first direction;

said guides guide said engaging portions provided on said pawl bendable by deflection so that said pawl is bent by deflecting said pawl in said first direction by a prescribed quantity; and said pawl is restored in said second direction by said prescribed quantity to cancel the bending of said prescribed quantity in said first direction, so that said engaging portions move to said stop portion extending from said guides in said second direction to be fixed.

* * * * *